United States Patent [19]

Schramek

[11] Patent Number: 4,621,381

[45] Date of Patent: Nov. 11, 1986

[54] KNOCKDOWN SOFA

[76] Inventor: Joseph L. Schramek, 9294 78th Pl., Seminole, Fla. 33543

[21] Appl. No.: 764,308

[22] Filed: Aug. 12, 1985

[51] Int. Cl.[4] ..... A47C 17/00

[52] U.S. Cl. ..... 5/51 B; 5/201; 5/285; 297/440

[58] Field of Search ..... 5/51 B, 51 C, 51 R, 5/282, 285, 286, 201; 297/440, 443, 444; 403/382

[56] References Cited

U.S. PATENT DOCUMENTS

| | | | |
|---|---|---|---|
| 638,466 | 12/1899 | Kelly | 5/51 B |
| 1,360,478 | 11/1920 | Wajtukiewicz | 5/51 B |
| 4,305,616 | 12/1981 | Martinez | 297/440 |

*Primary Examiner*—William F. Pate, III
*Assistant Examiner*—Dan W. Pedersen
*Attorney, Agent, or Firm*—Ronald E. Smith

[57] ABSTRACT

A knockdown sofa having a base, a pair of end members, a pair of side wall members, a pair of mounting block members and a pair of cap members. The mounting block members are employed to provide a mount for the end wall members and the cap members are employed to cap an end of the side wall members. The positions of the side wall members may be reversed, so that the left side wall becomes the right side wall and vice versa. Similarly, the end wall members are also reversible one with the other. When a reversal of these members is made, the positions of the mounting block members and the cap members reverse as well. In this manner, the sofa is made with half the parts that would be required in the absence of reversible parts. In sofas requiring reupholstering, all of the parts of the sofa requiring reupholstering may be removed individually from the base of the sofa and taken into the reupholstery shop.

7 Claims, 5 Drawing Figures

10
11
12
13
14
15
16
17
18
19
20
21
22
23
24
25
26
26a
27
28
28a
29
30
31
32
33
34
36
37
46
47
48
49

FIG_4
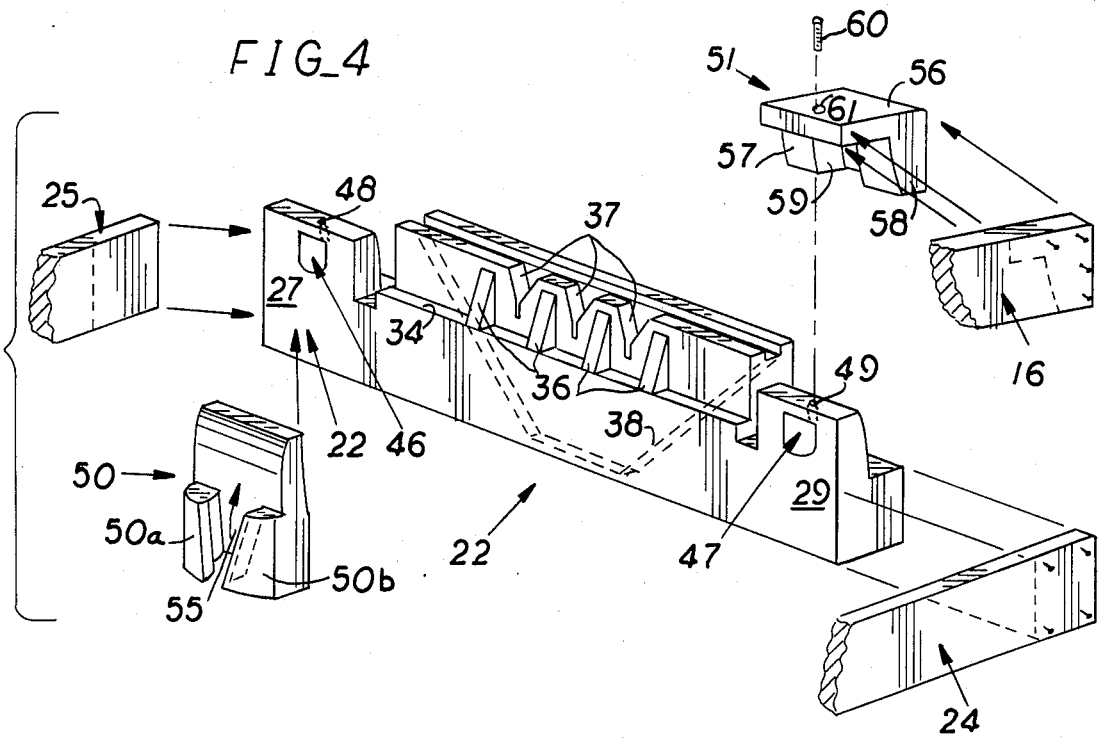
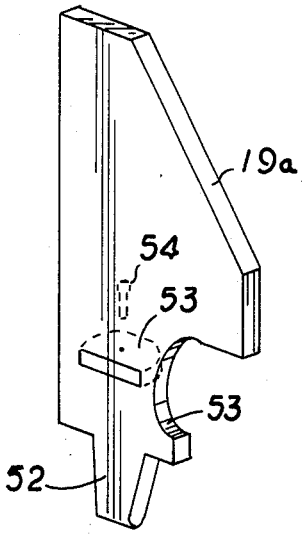
FIG_5

KNOCKDOWN SOFA

BACKGROUND OF THE INVENTION

1. Field of the Invention

This invention relates to furniture articles of the type that can be disassembled, or knocked down, and more particularly relates to a knockdown sofa having five (5) uniquely designed parts.

2. Description of the Prior Art

A search of U.S. patents that was conducted prior to the filing of this disclosure located the following patents in the field of this invention: U.S. Pat. Nos. 2,578,453 to Rozwens (1951); 3,104,913 to Faulkner and others (1963); 3,241,885 to Deaton (1966); 4,074,919 to Watts (1978); 4,077,517 to Hilemn (1978); 4,165,902 to Ehrlich (1979) and 4,305,616 to Martinez (1981).

Rozwen's sofa bed has a seat member supported by a frame structure in the form of a box; the seat-carrying frame structure in turn is supported at its opposite ends by arm structures which are interconnected by a bottom member upon which the frame structure rests. In this manner, all of the weight of the sofa bed is transmitted directly to the bottom member and its supporting arm structures. Bolts employed thus merely hold the assembled parts in their assembled relation, and are not subjected to shearing forces.

The knockdown sofa invented by Faulkner and others is held together by a large number of bolts, clips and retaining flanges; none of its parts interlock.

Deaton's disclosure shows many different articles of furniture of modular construction; dowel pins and hinges are employed in liberal amounts to connect the various parts together. Deaton also shows the use of tongue and groove construction.

Watts' patent shows a chair construction that may be interlocked as by bolts with another similar chair construction to form a sofa.

A knockdown chair having a back panel, a pair of arm panels, a seat panel and a pair of "L"-shaped positioning blocks is shown in the Hilemn disclosure. The positioning blocks facilitate joinder of the side and back panels.

Hook-like lugs engage complementally formed recesses in the Ehrlich knockdown sofa so that no tools are required to assemble and disassemble the sofa. The lugs and lug-receiving openings are similar to the connection means commonly used in bed frames where the side rails join the upstanding legs of the head and foot boards.

The most recent patent in the field of this invention shows modular elements interconnected by cross tie members and tongue and groove means.

The constructions of the prior art employ many pieces; some of them are so complex that they are assembleable and disassembleable by consumers only if the greatest attention is paid to lengthy and complicated instructions.

Inventors have concerned themselves with knockdown furniture constructions because it is costly to transport an item of furniture such as a chair or a sofa into a shop when the item requires reupholstering. With a knockdown piece, the parts of the furniture can be disassembled and taken to the shop with less expense. The part of the furniture not requiring reupholstering can simply be left in the consumer's residence or place of business.

There is a need for a knockdown sofa that has a small number of parts and which can be knocked down quickly and reassembled easily.

More particularly, there is a need for a knockdown sofa having a base which is not covered with upholstery so that all parts thereof can be disassembled and taken to a reupholsterer while the base is left behind.

SUMMARY OF THE INVENTION

The longstanding need for a sofa of the type for which there is a need is now fulfilled in the form of a sofa having, essentially, only five (5) parts.

A very unique side base member is provided which serves as a mount for the side wall and end wall members of the sofa. The side base member includes a medial portion having a truncated "V"-shaped groove formed therein. A complementally formed truncated "V"-shaped tongue depends to a side wall member and fits snugly into the groove. A plurality of bolts extend horizontally from the depending tongue and slideably fit into positioning slots formed in the side base member; wing nuts are then employed to make firm the fit between tongue and groove.

The portions of the side base member flanking the medial portion are corner base members. The corner base member positioned at the front of the sofa is capped by a cap member whereas its counterpart at the rear of the sofa is not. When the left and right side walls of the sofa are reversed, the position of the side base member is also reversed so the formerly rear corner base member becomes the front base member; thus, the position of the cap member is switched from one corner base member to the other at the time of reversal.

A mounting block member which defines a slot is releasably secured to the inner surface of the rear corner base member; a tongue depending to an end wall member is received within the slot. Thus, when side walls are switched, the mounting block members are also switched, i.e., they trade places with the cap members.

The side wall members also are provided with front and rear plates which are normal to the plane of the side walls. These plates are received in slots formed in the side base members intermediate the respective medial portions and corner base members to enhance the stability of the interlock between the side wall members and their respective side base members.

A primary object of the invention is to provide a fashionable knockdown sofa having a small number of parts.

Another important object of this invention is to provide a sofa having reversible parts so that the left side wall may be used as the right sidewall, and vice versa, and so that the left end wall may be used as the right end wall, and vice versa.

Still another object is to provide a knockdown sofa that relies upon a small number of bolts and nuts, while still having a high degree of stability when assembled.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 4 is an exploded perspective view showing the side base member of FIG. 2, a mounting block member and a cap member;

FIG. 5 is a perspective view of an end wall member.

Similar reference numerals refer to similar parts throughout the several views of the drawings.

DETAILED DESCRIPTION OF THE PREFERRED EMBODIMENT

Figures 1, 2:
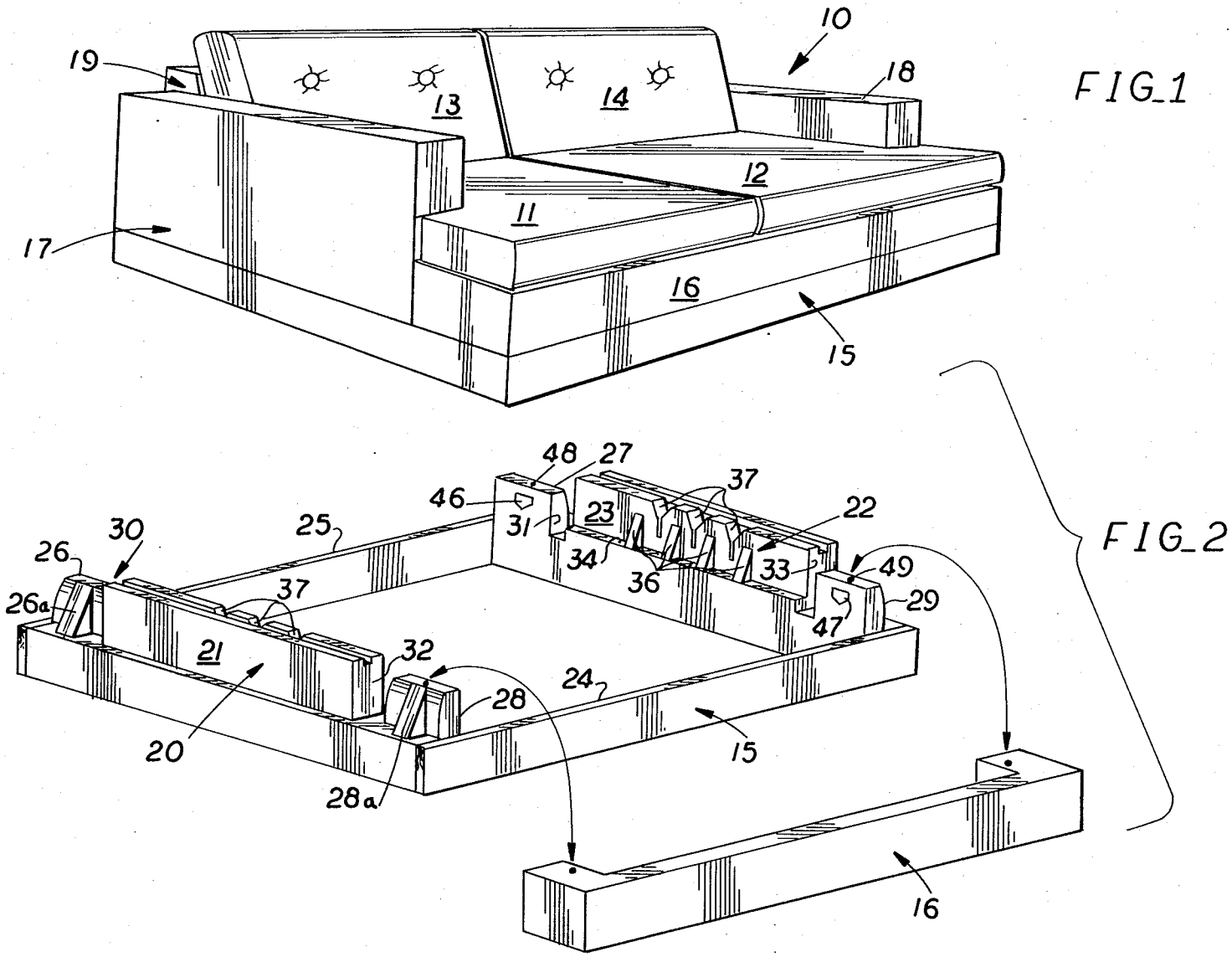
FIG. 1 is a perspective view showing the knockdown sofa of the present invention in its assembled configuration.
FIG. 2 is a perspective view showing only the base portion of the sofa in its assembled configuration.

Referring now to FIG. 1, it will there be seen that a sofa made in accordance with the teachings of this invention is represented by the reference numeral 10 as a whole.

Cushions 11, 12 are of the type known as the "T" type of cushion, due to the shape they form when placed side by side. Seat back cushions 13, 14 are also of the conventional variety.

Sofa 10 is supported by a rectangular base means which is indicated by the reference numeral 15, generally. The forward edge of cushions 11, 12 are supported by frontpiece member 16 which sits atop base 15 as indicated in FIG. 2. The other parts of the invention shown in FIG. 1 are the side wall or arm members 17, 18 and the end wall member 19. The other end wall member **19*a* is not visible in FIG. 1**.

Making reference now to FIG. 2, base means 15 includes a pair of longitudinally spaced side base members 20, 22 and conventional boards 24, 25 which interconnect them as shown.

The respective medial portions of the side base members 20, 22 are denoted 21, 23. Laterally outward of each medial portion is a base corner member, which base corner members are designated 26, 27, 28 and 29. Each base corner member is provided with a wedge-shaped projection **26*a*, 27*a* (not shown), 28*a*, 29*a*** (not shown) which projections serve to interlock with a groove on a capping member that will be disclosed hereinafter.

Slots 30, 31, 32 and 33 separate the respective medial portions from their laterally adjacent base corner members as shown in FIG. 2. The slots receive a portion of arm members 17, 18 as will become clear as this description proceeds.

Medial portion 23 is offset toward the outside of the base means 15 as shown in FIG. 2 to form ledge 34. A similar ledge is formed by medial portion 21. A plurality of spaced brace members, collectively designated 36, are positioned on ledge 34 and serve to brace medial portion 23. A similar set of braces are positioned on the ledge formed at the base of medial portion 21 as well.

A plurality of slots, collectively designated 37, are formed in the respective medial portions 21, 23 as shown, for purposes that will be made clear hereinafter.

As is suggested by the double-headed arrows appearing in FIG. 2, when the sofa is assembled, frontpiece 16 is positioned atop base corner members 28, 29 and secured thereto by screw means, not shown.

Figure 3:
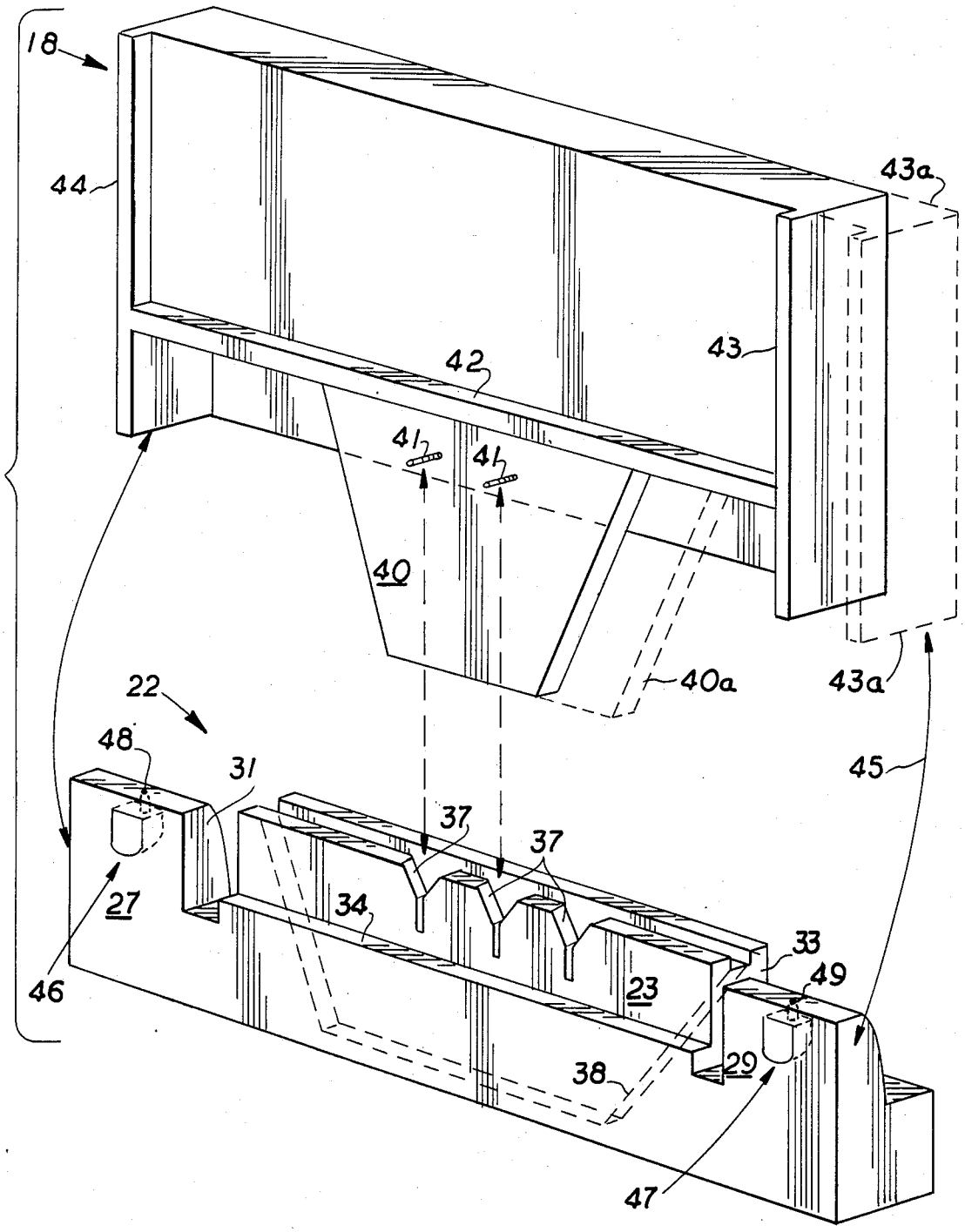
FIG. 3 is an exploded perspective view of a side base member and a side wall member.

Reference should now be made to FIG. 3 wherein side base member 22 is shown in greater detail, and wherein arm member 18 is also shown in full perspective. Braces 36 have been omitted from FIG. 3 to simplify the drawing.

A truncated "V"-shaped groove 38, shown in phantom lines, is formed in offset portion 23 of side base member 22. A complementally formed tongue 40 of side wall 18 sits therewithin when the sofa is assembled. Laterally spaced guide bolts 41 are slideably received within slots 37 to properly align the side wall 18 with its base member 22. Three slots 37 are formed in base member medial portion 23 because bolts 41 will engage different pairs of slots 37 when the position of the side wall is switched from the left to the right of the sofa, or vice versa. Wing nuts, not shown, are threaded onto bolts 41 to tighten tongue 40 to groove 38 and hence side wall 18 to side base member 22.

Tongue 40 depends to brace 42 which interconnects front panel 43 and back panel 44 of side wall 18. Panels 43, 44 are normal to the plane of side wall 18 and slideably fit within slots 31, 33, respectively, to further stabilize the assembly.

Where cushions other than the "T" cushions 11, 12 of FIG. 1 are employed, side wall 18 is provided in larger size as indicated by phantom lines **43*a*, and panel 43 will not fit within slot 33 but will extend beyond corner base member 29 as indicated by double-headed arrow 45. Tongue 40*a*** is also provided in larger form when the larger side wall is used.

A cavity 46 is formed in corner base member 27 as depicted in FIG. 3 and a similar cavity 47 is formed in corner base member 29. The respective cavities are flush with the inner surfaces of the corner base members within which they are formed, as depicted, and are in communication with the top surface of their associated corner base members via bores 48, 49, respectively. In this manner, when a bolt is inserted into a bore 48, 49, access to the bolt's nut may be had through the associated cavity.

FIG. 4 is an exploded view of side base member 22, mounting block member 50, cap member 52, front and back base boards 24, 25, and frontpiece 16.

As shown in FIG. 5, end wall member **19*a* has a depending tongue 52 and a cut out portion 53; the function of the cut out portion is to allow free movement of frame members, not shown, that form a bed when swung outwardly of the sofa base in the well known manner. A horizontally disposed cantilevered wall 53 is secured to either side of end wall 19*a*, depending upon whether wall 19*a* is being used as a left or right end wall. Wall 53 is apertured as shown to receive a bolt 54 that extends through wall 53 and, as shown in FIG. 4, into bore 48 and cavity 46 of the base corner member 27**.

Mounting block member 50 has laterally spaced arms **50*a*, 50*b* which define a truncated "V"-shaped opening into which is slideably inserted tongue 52 of end wall 19*a* when mounting member 50 is removably secured to base corner member 27 as by tacks 55. When the position of side base member 22 is reversed from one side of the sofa to the other, mounting member 50 is removed from corner base member 27 and removably secured with tacks to corner base member 29**.

Cap member 51 has a top wall 56 and side walls 57, 58 which define a slot 59 therebetween. Slot 59 mates with wedge shaped member **29*a* (not shown) of corner base member 29; reference should be made to FIG. 2 and to the wedge-shaped members 26*a*, 28*a* which are the counterparts to the wedge-shaped projections 27*a*, 29*a*** which are not shown in FIG. 4. Bolt 60 extends through top wall 56 at aperture 61 to removably secure cap member 51 to base corner member 29; bolt 60 extends through aperture 49 and into cavity 47 in the manner depicted in the drawing. When the side base member 22 is rotated one hundred eighty degrees in a horizontal plane, i.e., when its position is switched to the right side of the sofa 10, bolt 60 is removed so that cap member 51 may be positioned in mating engagement with base corner member 27, it being understood that mounting block member 50 would at such time be re-positioned and secured to base corner member 29.

Side base members 20, 22 are identical in construction, as are side wall members 17, 18, and end wall members 19, 19*a*. Thus, only five (5) different parts need be constructed to provide the novel sofa, namely, the three (3) parts just mentioned, the mounting block members 50 and the cap members 51.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. An article of furniture of the type that can be assembled and disassembled, comprising:

a generally rectangular base portion including a pair of laterally spaced side base members;

each of said side base members having a medial portion; a front corner base member and a rear corner base member;

a pair of laterally spaced side wall members;

a pair of laterally spaced end wall members;

a depending tongue member formed on each of said side wall members;

a groove formed in each of said side base members corresponding in configuration and dimension to an associated tongue member;

a depending tongue member formed on each of said end wall members;

a mounting block member releasably secured to preselected ones of said corner base members;

each of said mounting block members configured and dimensioned to releasably receive a tongue member depending to its associated end wall member;

a pair of cap members configured and dimensioned to releasably engage preselected ones of said corner base members;

said mounting block members and said cap members being interchangeably positioned when said side wall members of said sofa are interchanged;

a pair of slot means formed in each of said side base members, a first one of said slot means formed between a rear corner base member and said medial portion of said side base member, and a second one of said slot means formed between a front corner base member and said medial portion of said side base member.

2. The article of claim 1, wherein each of said side wall members further comprises a front panel disposed normal to a plane within which said side wall member lies and a rear panel disposed normal to said plane, said front and rear panels extending toward each other and fitting snugly within an associated slot means.

3. The article of claim 2, wherein all of said corner base members have a common form which includes a wedge-shaped projection member formed on the side thereof that faces outwardly with respect to the sofa.

4. The article of claim 3, wherein said cap members are formed complementally with respect to said corner base members, said cap members having a slot formed therein which is configured and dimensioned to receive said base corner member wedge-shaped projections.

5. The article of claim 4, wherein said medial portions of said side base members are offset with respect to said corner base members, said offset forming a ledge means upon which are disposed in spaced relation to one another a plurality of brace members.

6. The article of claim 5, further comprising a plurality of vertically extending slot means formed in an inwardly facing wall of the respective medial portions of said side base members.

7. The article of claim 6, further comprising a plurality of horizontally disposed, inwardly extending bolt members projecting from the respective tongue members that depend to said respective side wall members, said bolt members slideably fitting within said slot means, and further comprising nut means to tighten the engagement of said respective side wall member tongues and side wall member grooves.

* * * * *